United States Patent [19]

Barney

[11] Patent Number: 4,792,817

[45] Date of Patent: Dec. 20, 1988

[54] INK JET PRINTING SYSTEMS

[75] Inventor: Howard H. Barney, Berkeley, Calif.

[73] Assignee: Diagraph Corporation, Herrin, Ill.

[21] Appl. No.: 851,347

[22] Filed: Apr. 14, 1986

Related U.S. Application Data

[63] Continuation of Ser. No. 723,153, Apr. 15, 1985, abandoned, which is a continuation of Ser. No. 527,479, Aug. 29, 1983, abandoned.

[51] Int. Cl.[4] ..... B05C 5/02; B05B 1/02

[52] U.S. Cl. ..... 346/140 R; 118/313

[58] Field of Search ..... 346/33 R, 75, 140 R; 400/126; 364/132, 131, 518, 519; 251/294, 368, 129; 118/315, 313, 25

[56] References Cited

U.S. PATENT DOCUMENTS

| | | | |
|---|---|---|---|
| 1,709,926 | 4/1929 | Weaver . | |
| 2,278,940 | 4/1942 | Murphy | 178/5.2 |
| 3,279,422 | 10/1966 | Landers | 118/25 |
| 3,757,349 | 9/1973 | Fulton | 346/49 |
| 4,002,230 | 1/1977 | Schweppe et al. | 197/1 |
| 4,146,900 | 3/1979 | Arnold | 346/75 |
| 4,215,350 | 7/1980 | Mielke et al. | 346/75 |
| 4,228,821 | 10/1980 | Stark | 137/533 |
| 4,288,849 | 9/1981 | Yoshida et al. | 364/102 |
| 4,378,564 | 3/1983 | Cross et al. | 346/75 |
| 4,393,386 | 7/1983 | DiGiulio | 346/75 |
| 4,415,910 | 11/1983 | Reece | 346/140 |
| 4,576,111 | 3/1986 | Slomeanny | 118/313 |

*Primary Examiner*—John McIntosh

*Attorney, Agent, or Firm*—Senniger, Powers, Leavitt and Roedel

[57] ABSTRACT

An ink jet printing system comprising a plurality of ink jet printheads each having a matrix of ink jets, each jet having a nozzle constituting a valve seat at its outlet end, the seat having an orifice for ejection of drops of ink, a solenoid-actuated valve member engageable with and disengageable from the seat to close and open the orifice, a controller for each printhead comprising a microcomputer for processing data for actuating the solenoids to print messages and storing the data, a console for all the printheads having a microcomputer for processing data for delivery to the printheads and operable to store data for a plurality of messages, and a terminal for generating data for messages for delivery to the console or, alternately, directly to the printhead controllers for a minimum system.

16 Claims, 4 Drawing Sheets

INK JET PRINTING SYSTEMS

CROSS REFERENCE TO RELATED APPLICATION

This application is a continuation of U.S. patent application Ser. No. 723,153 filed Apr. 15, 1985, which is a continuation of U.S. patent application Ser. No. 527,479, filed Aug. 29, 1983, both said applications now being abandoned.

BACKGROUND OF THE INVENTION

This invention relates to ink jet printing systems, and more particularly to computer-controlled systems of this class.

The invention is concerned with an ink jet printing system for printing on moving surfaces, such as on cartons or boxes being fed forward by a conveyor, and is in the same general field as the systems shown in U.S. Pat. Nos. 4,002,230 and 4,378,564.

SUMMARY OF THE INVENTION

Among the several objects of this invention may be noted the provision of an improved ink jet printing system of the class described better adapted for use in different types of installations and better adapted, once installed, to changing needs; the provision of such a system which is relatively easy to set up, operate and service; the provision of a multi-tasking system of the class described, adapted to include as many as eight printheads, for example, with some acting to print on objects (e.g., cartons or boxes) moving one way or the other with respect to the associated printhead or printheads; the provision of such a system enabling control over the printing in accordance with the speed of the objects being fed past the printheads and selection of the location of a printed message on the objects; and the provision of a printhead with a fast-acting anti-clogging ink ejection system operable with precise ink drop formation for optimizing print quality and also for minimizing waste of ink.

In general, a system of this invention is adapted for ink jet printing of messages on objects such as cartons or boxes being fed forward one after another in a predetermined path. It comprises a plurality of ink jet printheads positioned adjacent to said path to print the messages on the objects as they travel forward in said path. Each printhead comprises a plurality of ink jets arranged in a matrix and adapted for ejection of drops of ink across a gap to a surface of an object travelling by the printhead to print dots on said surface in patterns forming selected characters such as letters and numerals for said messages. Means is provided for supplying ink to the jets, also a plurality of electrically actuated valve means, one for each jet, each adapted for electrical operation for ejection of a drop of ink from the respective jet. The system further comprises a terminal including a keyboard for entering message data, a message bank having a microcomputer interconnected with the terminal for processing data received from the terminal and storing the data for a plurality of messages, and a plurality of controllers, one for each printhead, each including a microcomputer interconnected with the bank for processing data for a selected message received from the bank and storing the data. The bank has means for effecting transfer of data for a selected message from storage therein to a selected controller for storage in that controller. Each controller has an output circuit interconnected with the microcomputer thereof and with the respective printhead for receiving output of data for the selected message from that microcomputer and converting the data to driving signals for the printhead valve means for actuating the latter to print the selected message.

In another aspect, each jet comprises an elongate tubular member having an outlet nozzle constituting a valve seat at one end thereof, said seat having an orifice for ejection of drops of ink, said tubular member having an ink chamber therein for holding ink under pressure for delivery through the orifice, said chamber being defined by the valve seat and by means in the tubular member spaced from the seat sealing against escape of ink from the chamber. A valve stem extends longitudinally in said tubular member having a valve member at its end toward the seat engageable with the seat to block flow in ink through the orifice in the seat. The valve stem is movable longitudinally in said tubular jet member for closing the valve member against the seat and for opening it for ejection of a drop of ink through the orifice. And a solenoid is provided for each jet, each solenoid being connected to a respective valve stem for actuating the latter.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
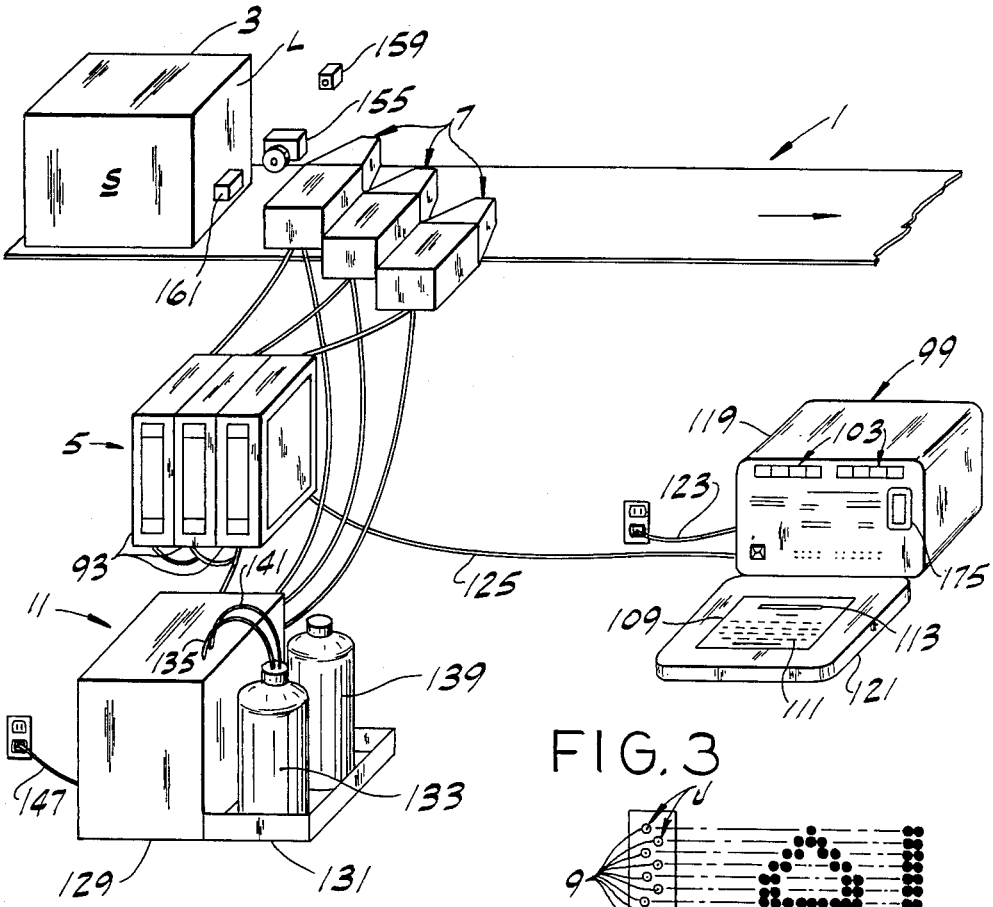
FIG. 1 is a semi-diagrammatic view of an ink jet printing system of this invention.

Referring to FIG. 1, there is indicated at 1 a conveyor for feeding forward one after another at spaced intervals a succession of objects 3, such as cartons or boxes, on which messages are to be printed by means of the ink jet printing system of this invention designated in its entirety by the reference numeral 5. The term "message" is intended to cover any item of information, such as a product code.

Figure 3:
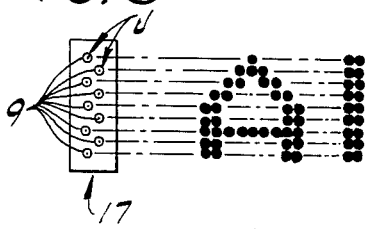
FIG. 3 is a view illustrating a matrix of ink jets of the printhead and pattern of dots printed thereby.
Figure 2:
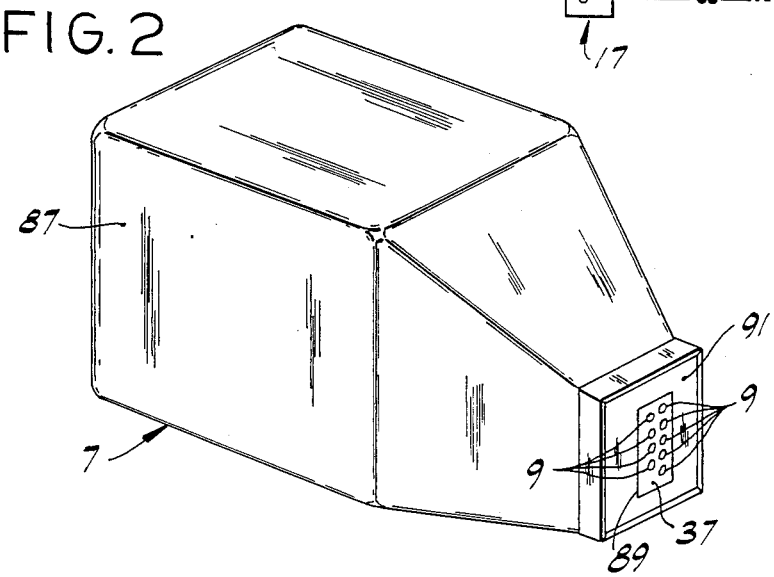
FIG. 2 is a perspective of a printhead of the system.
Figure 4:
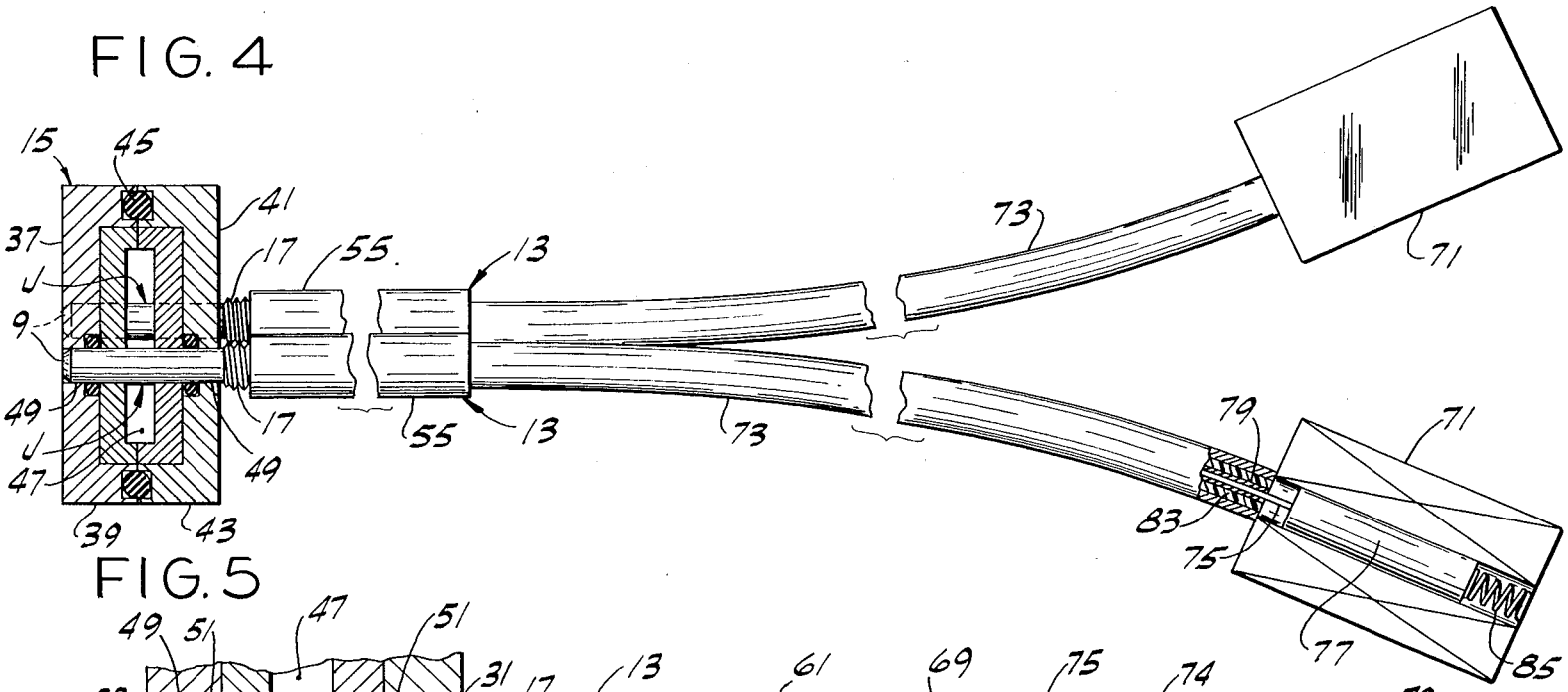
FIG. 4 is a view with parts broken away and shown in section of an ink manifold of the printhead and associated ink jets and valve actuating means.

The ink jet printing system 5 of this invention is shown in FIG. 1 to comprise a plurality of ink jet printheads each designated 7 positioned alongside and adjacent the path of the objects to print the messages on the objects as they travel forward along said path (left to right as viewed in FIG. 1) past the printheads. Three printheads 7 are shown in FIG. 1 by way of example, arranged to print three different messages on three different lines Each comprises a plurality of ink jets each generally denoted by the reference character J and each including an outlet nozzle 9, these jets being arranged in a matrix and adapted for ejection of drops of ink across a gap between them and an object 3 travelling past them to a surface S of the object (one side of a carton) to print dots on said surface in patterns forming selected characters such as letters, numerals and other symbols for said messages. As shown in FIGS. 2 and 3, there are nine ink jets and hence nine nozzles 9 arranged in two side-by-side closely adjacent columns of five nozzles and four nozzles, respectively, the four nozzles in the four-nozzle column being staggered with respect to the five nozzles in the five-nozzle column. With this nozzle arrangement, various patterns of dots may be printed on surface S. FIG. 3 shows a pattern of dots for the characters "Al" in what is called "bold" font (large character printing) in which each vertical dot column is doubled. At 11 is generally indicated means for supplying ink to the nozzle. A plurality of electrically actuated valve means, one for each jet J, and each designated 13, is provided in each printhead. Two such valve means 13 are shown in FIG. 4 (one in FIG. 5). It will be understood that for the nine jets of each printhead 7, there are nine such valve means 13, one for each jet. Each said valve means 13 is adapted for relatively momentary operation electrically for ejection of a drop of ink from the respective jet nozzle 9 (i.e., the nozzle associated therewith).

Figure 5:
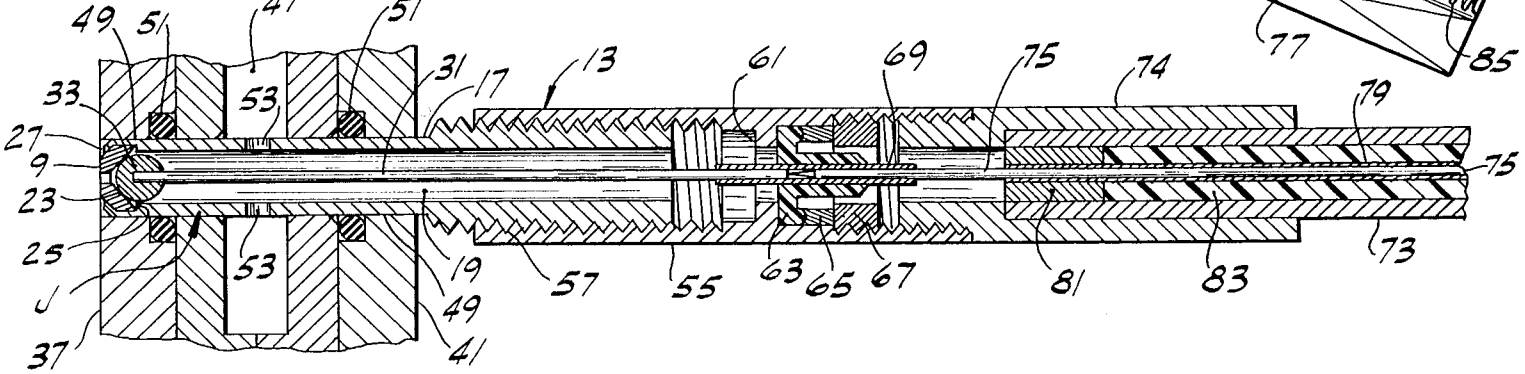
FIG. 5 is an enlargement of a fragment of FIG. 4 with parts shown in section.

As shown more particularly in FIGS. 4 and 5, each of the printheads 7 comprises means indicated generally at 15 mounting the jets J in the stated matrix for the non-contact printing of patterns of dots to form characters including letters, numerals and other symbols on the target surface S of the objects 3 moving relative to the jets past the jets, by the selective squirting of ink from the jets on the target surface. Each jet comprises an elongate tubular member 17 having an ink chamber 19 therein for retaining ink under pressure. Secured in one end of this tubular member constituting the outlet and thereof is the aforesaid nozzle 9. The nozzle, per se, is a circular jewel, preferably sapphire, having a relatively small circular central orifice 21 with a tapered or countersunk (conical) opening 23 at the inside thereof in communication with (leading to) the central orifice. The sapphire nozzle constitutes a valve seat of the respective valve means 13, being mounted in the outlet end of the tubular jet member 17 in engagement with an internal annular shoulder 25 in member 17 and held therein by peening over the end of the tubular jet member as indicated at 27. A valve stem or rod 31 extending longitudinally in the tubular jet member 17 has a ball valve member 33 secured on its end toward the outlet end of the tubular member engageable with the tapered or conical valve seat surface of the nozzle or seat 9 in the opening 23 to block flow of ink through the orifice 21 in the seat. The ball valve member may be a carbide ball or a spherical jewel, and is preferably a spherical ruby. The stem 31 is movable longitudinally in the tubular jet member 17 for closing the ball valve member 33 against the valve seat 9 and for opening it for a relatively brief interval for ejection (squirting) of a drop of ink through the orifice 21.

The means 15 mounting the jets J, more particularly the tubular jet members 17, in the stated matrix (the five plus four matrix) constitutes an ink manifold for holding ink under pressure. This manifold comprises a front part and a back part, the front part comprising a front wall 37, which is the wall facing the objects 3, having a rearwardly extending peripheral flange 39, and the back part comprising a back wall 41 having a forwardly extending peripheral flange 43. These parts are assembled with the flanges in butting engagement and sealed by an O-ring as indicated at 45, the flanges spacing the walls from each other and thereby defining a manifold chamber 47 for holding ink under pressure. The parts are suitably secured together with the seal 45 under compression by means such as screws (not shown).

The walls 37 and 41 have a plurality of holes as indicated at 49 receiving the tubular jet members 17 with these members extending from the front wall 37 back across the manifold chamber 47 and out through the back wall 41 as shown in FIGS. 4 and 5. Each tubular jet member 17 is sealed in the walls 37 and 41 as indicated at 51 and has lateral ports 53 in communication with the manifold chamber 47 for feeding ink from the manifold chamber to the ink chamber 19 in the tubular jet member 17.

Each of the tubular jet members 17 extends forward through the manifold 15 from an elongate tubular body member 55, member 17 being threaded at 57 in the forward end of the body member 55. The valve stem or rod 31 extends rearward from the guide member into the body member 55. The ink chamber 19 in the tubular jet member 15 is constituted by the space therein rearward of the nozzle 9 at the forward end of member 17. The body member 55 has an annular flange 61 therein against the rear face of which a flexible resilient diaphragm 63 is held by means of an annular thrust member 65 and a retainer 67 threaded in the reaward end of the body member. The diaphragm, which may be made of EPR rubber, for example, has an axial tubular coupler or sleeve 69 bonded therein extending forward and rearward. The valve stem or rod 31 is secured at its rearward end in this coupler. A solenoid 71 for operating the valve stem or rod 31 is mounted on the rearward end of a solenoid support tube 73 which extends rearward from the body member 55. This tube 73 has an adaptor 74 at its forward end threaded in the rearward end of the body member 55. A flexible drive wire 75 secured to the plunger 77 of the solenoid extends through a metal capillary tube sheath 79 in the support tube 73 and is secured at its forward end in the coupler 69, the latter thus serving to couple wire 75 and the valve stem or rod 31. The forward end of the sheath 79 is fitted in an annular spacer 81 in the forward end of the support tube 73 within the adapter 74, and the space within the tube 73 around the sheath has a suitable plastic spacer means 83 therein.

As diagrammed in FIG. 4, the solenoid 71 has spring means 85 biasing its plunger 77 in forward direction to bias the drive wire 75 and the valve stem 31 (which are coupled together by the coupler 69) forward so as to bias the valve ball 33 to its closed position illustrated in FIG. 5 against the nozzle or valve seat 9. The diaphragm 63 serves not only to seal the body 55 against leakage of such ink but also to bias the valve stem or rod 31 in the forward direction for nozzle closure. The arrangement is such that, on energization for a brief interval of the solenoid 71, the armature 77 is driven rearward to pull the drive wire 75 and rod 31 rearward to move the ball 33 away from the valve seat or nozzle 9 for ejection of a drop of ink from the nozzle, and on deenergization of the solenoid, the ball 33 is biased back to closed position engaging the seat to cut off the ink.

The ink jets are relatively small and closely spaced, and the solenoid support tubes 73, of which there are nine, one for each jet, are bent or flared so that the rearward ends of the tubes are sufficiently spaced to provide room for the solenoids. The manifold 15, jets J, body members 55, support tubes 73 and solenoids 71 form an assembly which is housed in a printhead housing 87, with the front wall 37 of the manifold and the forward ends of the jets J in the holes 49 in the front wall 37, and with nozzles 9 at the forward ends of the jets, facing the outside through a rectangular window opening 89 at the forward end 91 of the housing 87. As appears in FIG. 2, the housing 87 is enlarged back from its forward end to accomodate the flaring of solenoid support tubes 73.

Figure 6:
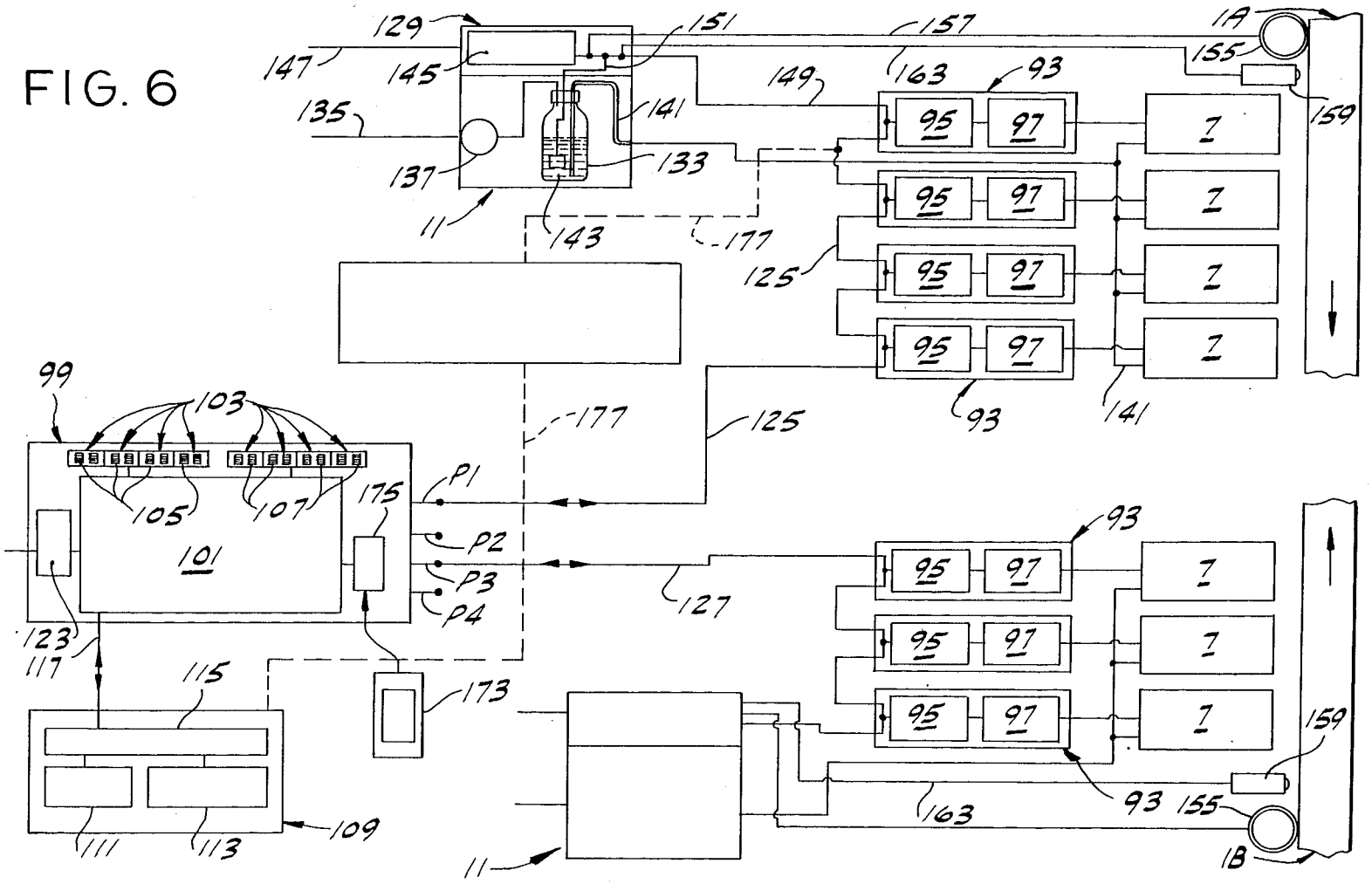
FIG. 6 is a block diagram showing an installation of the system with four printheads for printing on objects moving from left to right with respect to these four printheads and three printheads for printing on objects moving from right to left with respect to these printheads, and showing the circuitry for the system.

Again referring to FIG. 1, the ink jet printing system 5 is shown further to comprise a plurality of control modules, one for each printhead 7, each such modue being designated 93. These control modules may also be referred to as the printhead controllers. As shown in FIG. 6, each controller 93 includes a microcomputer 95 for processing data for actuating the solenoids 71 of the several valve means 13 of the respective printhead 7 to print a message, storing the data for a message and delivering signals for actuating the solenoids for opening the ball valves 33 of the nine valve means 13 at the proper times and in the proper sequence for ejection of drops of ink from the nozzles 9 in the pattern to print the message. Each printhead controller microcomputer 95 contains a CPU chip, ROM's RAM's, a UART, counter/timer chips, interface chips, and support chips such as a crystal controlled clock, buffers, and drivers for various signals. The microcomputer 95 communicates with the console 99 or terminal 109 using a RS-422 serial interface at 38,000 Baud. Information is transmitted in both directions in ASCII format. Message data is converted from ASCII to a particular font by the printhead controller microcomputer 95 and other fonts can be sent from the console 99 and stored in RAM. Since several printhead controllers 93 can be daisy-chained together on a single cable from the console, the operating system uses a pollins protocol when communicating with the printhead controllers. Each printhead microcomputer 95 has on it an array of eight small switches which can be set to various combinations for setting options. Four of the switches are used to select an identification number or address so that the console 109 can communicate with the appropriate printhead by sending out its identification number at the beginning of a sequence. Up to 16 different addresses are possible and no two printheads on one daisy chain can have the same identification number. Each printhead controller 93 also includes an output circuit or driver means 97 which receives output signals from the microcomputer and converts them to variable pulse length actuating power signals for the solenoids 71 for actuating the valve means 13 in accordance with the signals.

A master controller 99 for the several printhead controllers 93 has a microcomputer 101 for processing data for delivery to the printhead controllers 93, and is operable to store data for a large number of different messages to be printed, e.g., messages totalling up to 1000 characters, in a non-volatile memory immune to power loss. Typically, the memory is configured as 25 message lines of 40 characters each. The master controller 99 contains a power supply, microprocessor, ROM, RAM, EEPROM, and its special write circuitry, clock/calendar chip with battery backup, line drivers, receivers, UARTs, support and interface circuitry. The master controller 99, which may also be referred to as the console or message data bank or base, has a plurality of message routing switch units each designated 103, one for each printhead 7, each adapted to route a selected message from the console 99 to the corresponding printhead 7. For eight printheads, there are eight such units, each comprising, for example, a pair of thumbwheel switches 105 and 107. One of these thumbwheel switches sets tens and the other sets ones for a message code number. For example, setting the numeral 1 on the first switch and 5 on the second switch of the first pair 103, this being the pair for routing a message to the first printhead, results in transmission of data for the message identified by code number 15.

Associated with the console 99 is a terminal 109 for entering data for the messages. This has a keyboard indicated at 111 for typing messages, a display 113, e.g., a liquid crystal display, for displaying the typed material for review and editing, and a microprocessor 115 and support circuits for processing the message data and transferring it to the console for storage in the memory of the console. The terminal 109 is interconnected with the console 99 as indicated at 117. Messages stored in the console 99 may be fed back to the terminal 109 via 117 and displayed on the display 113. The display may also be used to display information on the operating status of the system, e.g., a count of the number of objects marked by each printhead since the last message was routed to it (or since the last reset), low ink warnings, error conditions, etc.

As illustrated in FIG. 1, the console 99 is housed in a case 119 (e.g., a high impact aluminum case) having a hinged lid 121 adapted to be locked in place. The terminal 109 is removably nested in the lid. Typically, the terminal has 59 color-coded keys, divided into 44 upper and lower case character keys and 15 function keys, organized in standard typewriter style layout. A plug-in power supply for the console and terminal is indicated at 123.

The console is illustrated in FIG. 6 as having four ports designated P1–P4 for interconnection with up to eight printhead controllers 93 for eight printheads 7, for example, with the printheads arranged in any manner to serve up to four different conveyors. As illustrated in FIG. 6, port P1 is interconnected by an interconnect bus cable 125 with four controllers for four printheads 7 serving a first conveyor 1A, and port P3 is interconnected by an interconnect bus cable 127 with three controllers 93 for three printheads 7 serving a second conveyor 1B. Each bus cable contains a plurality of pairs of conductors (e.g., six pairs) for servicing a plurality of printhead controllers (e.g., six printhead controllers).

The ink supply means 11 comprises an ink station 129 including a tray 131 for holding a bottle of ink 133 with an air pressure input indicated at 135 in FIG. 6 for pressurizing ink in the bottle, this system including a pressure regulator 137. A reserve bottle 139 is shown in the tray in FIG. 1. An ink supply means 11 is provided for each set of printheads 7 for each conveyor. Thus, two ink supply means 11 are shown in FIG. 6. Each ink supply bottle 133 is connected to the ink manifolds 15 of the set of printheads 7 serving the respective conveyor as indicated at 141. A low ink level sensor 143 is provided in the ink supply bottle. The ink station is also a power station for the printheads 7 associated therewith, having a power supply unit 145 for supplying power to the printhead controllers 93. This unit has an AC power input 147 and an output bus cable 149 interconnected with the respective bus cable 125 for interconnection with the microcomputers 95 of the printhead controllers 93 for the set of printheads 7 serving the respective conveyor (e.g., 1A). The sensor 143 is interconnected with the bus cable 149 as indicated at 151 for transmitting a low ink level signal back to a warning means (e.g., a warning lamp) associated with the console 93. A warning lamp may also be provided at the ink station.

The microcomputer 95 of each printhead controller 93 is responsive to the speed of feed of the objects or targets 3 past the respective set of printheads 7, i.e., the speed of the respective conveyor (e.g., 1A), for properly timing the ejection of drops of ink from the nozzles 9 for properly printing the message on each object or target 3 as it travels past the printhead at that speed. For this purpose, a speed sensor 155 is provided for sensing the speed of the conveyor and transmitting data corresponding to the speed to the associated controllers 93 for varying the timing of operation of the solenoids 71 for operating the valve means 13 in accordance with the speed. As illustrated, the speed sensor is a rotary encoder which generates pulses at a rate in accordance with the conveyor speed and transmits the pulses via a line 157 to the cable 149 for being multiplexed out to the associated printhead controllers 93.

Figure 7:
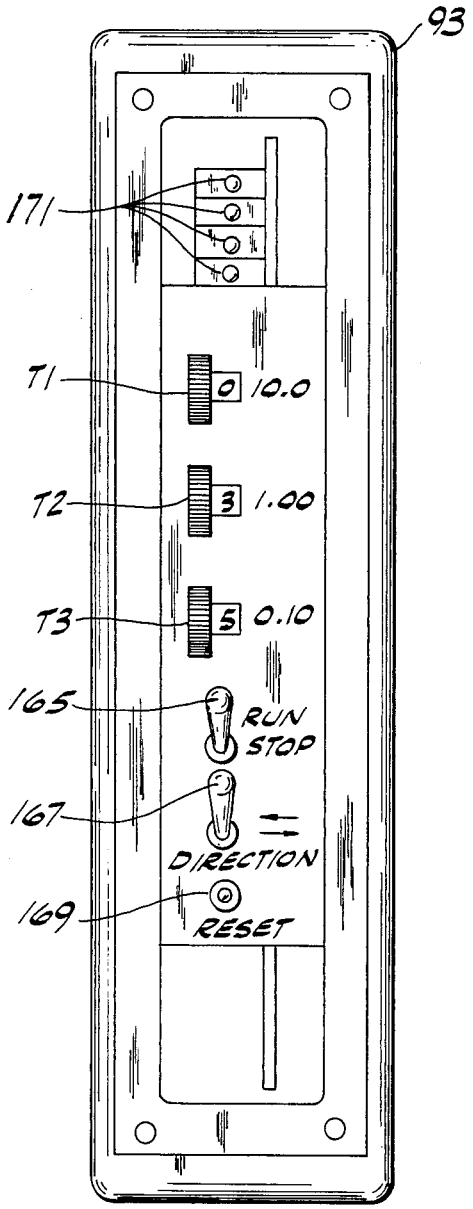
FIG. 7 is a front elevation of a controller for a printhead.

The microcomputer 95 of each controller 93 is also responsive to the location of each object of target 3 relative to each printhead 7 to control the start of printing so as to select the location of the printed message on the object or target, i.e., to control the spacing of the message on the side target faces of the object or target from the leading face L of the object or target. For this purpose, a photocell 159 is provided at one side of the conveyor adapted to receive a beam of light rejected from a reflector 161 at the other side of the conveyor. As each object or target is fed forward, it is registered by the photocell 159 and the latter thereupon transmits a start signal via a line 163 to the cable 149 for being multiplexed out to the associated controllers 93. The microcomputer 95 of each of the controllers 93 includes a variable delay circuit for delaying the start of operation of the valve means 13 for a predetermined interval after receipt of the start signal generated by the photocell 159. The controller 93 has a set of thumbwheel switches for setting this delay. As shown in FIG. 7, there are three such switches T1, T2 and T3, the first being calibrated in tens of inches, the second in inches and the third in tenths of inches, to enable setting to within a tenth of an inch the distance from the leading face L of an object 3 back to the point where printing begins.

Each printhead controller 93 also has a run/stop switch 165 (illustrated as a toggle switch) for activating or deactivating it and the respective printhead and a direction switch 167 (illustrated as a toggle switch) interconnected with the microcomputer 95 of the controller 93 adapted to be set in a first position for controlling said microcomputer for printing on objects 3 moving from left to right past the respective printhead 7, and in a second position for controlling said microcomputer for printing on objects moving from right to left past the respective printhead. The controller 93 also has a reset switch 169 (illustrated as a push-button switch) for the usual reset purposes, and may have light-emitting diodes such as indicated at 171 which light up in various patterns as part of self-testing procedures programmed in the microcomputer 95. The controller 93 may also have internal controls for the driver circuit 97 for controlling dot size by varying the length of pulses for actuating the solenoids 71.

The console 99 is shown as configured for reception of data storage means, e.g., a software cartridge 173 containing a chip, pre-programmed with data for a plurality of messages, e.g., twenty-five messages, for increasing (e.g., up to fifty) the number of messages stored in the console. The latter is shown as having a slot 175 for insertion of the cartridge. It may also have a clock/calendar for computing the time and the date for a long span of years. The cartridge may have a non-volatile EEPROM chip therein, like the console, and may be programmed from the console 99 via keyboard 111.

In a typical mode of use of the ink jet printing system of this invention, messages to be printed are entered in the system by typing on the portable terminal 109, displayed on the display 113 of the terminal and edited, and the message data is transmitted via line 117 from the terminal to the console or message bank 99 and stored in the memory of the microcomputer of the latter. Data for up to twenty-five message lines of forty characters each, for example, may be stored in the console. The number of stored messages may be augmented by use of a cartridge 173. The printhead controller 93 for each printhead 7 which is to print a message on the objects 3 being fed forward by the conveyor is programmed for controlling the respective printhead to print that message by routing the data for that message from the console or message bank 99 to the microcomputer of the printhead controller by means of the appropriate set 103 of thumbwheel switches 105 and 107 and storing it in memory in the printhead controller.

Each printhead controller 93 is set for the direction of feed of the objects 3 by the conveyor (left to right or right to left past the respective printhead) by means of the direction switch 167. It is also set for the desired spacing of the message from the leading end L of the objects 3 by means of the delay-setting switches T1–T3, and set to run by means of the switch 165. As each object 3 travelling forward is perceived by the photocell 159, and after the time delay interval interposed by the setting of switches T1–T3, output signals from the microcomputer 95 of the printhead controller 93 via the output circuit 97 effects the relatively momentary energization of the solenoids 71 of the respective printhead 7 relatively momentarily to open the nozzles 9 for ejection of drops of ink on the moving target surface S of each object in a sequence to print the pattern of dots for the programmed message.

In another type of installation, referred to as a standalone installation, the console 99 is not used, the terminal 109 being direct-connected to a printhead controller 93 as indicated at 177 in FIG. 6. In this type of installation, the message to be printed by the so-connected printhead 7 is entered directly in the printhead controller 93 from the terminal 109, the latter may then be unplugged and removed, and the printhead will continue to print the same message until a new message is substituted.

Of special importance is the structuring of each jet J as an elongate tubular member 15 with the nozzle 9 constituting a valve seat at the outlet and thereof and with the ball valve member 33 on the end of the solenoid-actuated valve stem or rod 31 engageable with the seat, as distinguished from a system such as shown in the aforesaid U.S. Pat. No. 4,378, 564 wherein the jet valve is upstream from the jet nozzle, there may be a tendency for development of reflective pressure pulses in the ink passage from the valve to the nozzle, with consequent ejection of individual drops (which are sometimes referred to as "satellite" drops) on each pulse, resulting in spattered printing. This pressure pulsing and consequent spattering is avoided by the present invention wherein the nozzle is the valve seat and is located at the outlet end of the jet, so that there is no passage wherein reflective pressure pulses may develop between a valve seat and a nozzle.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A system for ink jet printing of messages on objects being fed forward one after another in a predetermined path, said system comprising:

a plurality of ink jet printheads positioned adjacent said path to print the messages on the articles as they travel forward in said path;

each printhead comprising a plurality of ink jets arranged in a matrix and adapted for ejection of drops of ink across a gap to a surface of an object travelling by the printhead to print dots on said surface in patterns forming selected characters for said messages;

means for supplying ink to the jets;

a plurality of electrically actuated valve means, one for each jet, each adapted for electrical operation for ejection of a drop of ink from the respective nozzle, a terminal including a keyboard for entering message data, a message bank having a microcomputer interconnected with the terminal for processing data received from the terminal and storing the data for a plurality of messages, a plurality of controllers, one for each printhead, each including a microcomputer interconnected with the bank for processing data for a selected message received from the bank and storing the data, means for effecting transfer of data for a selected message from the bank to a selected controller for storage in that controller, each controller having an output circuit interconnected with the microcomputer thereof and with the respective printhead for receiving output of data for the selected message from that microcomputer and converting the data to driving signals for the printhead valve means for actuating the latter to print the selected message, wherein each jet comprises:

an elongate tubular member having an outlet nozzle constituting a valve seat at one end thereof, said seat having an orifice for ejection of drops of ink, said tubular member having an ink chamber therein for holding ink under pressure for delivery through the orifice, said chamber being defined by the valve seat and by means sealing against escape of ink from the chamber, a valve stem extending longitudinally in said tubular member having a valve member at its end toward the seat engageable with the seat to block flow of ink through the orifice in the seat, the valve stem being movable longitudinally in said tubular jet member for closing the valve member against the seat and for opening it for ejection of a drop of ink through the orifice, said ink supply means supplying the ink chambers of said tubular jet members with ink under pressure, and plurality of solenoids, one for each jet, each connected to a respective valve stem for actuating the latter, said system having mounting means for the tubular jet members comprising an ink manifold for holding ink under pressure, said manifold having a front wall and back wall spaced from each other and defining therebetween a manifold chamber for holding ink under pressure, said walls having a plurality of holes receiving the tubular jet members with the latter extending through the holes in the back wall across the manifold chamber into the holes in the front wall, each tubular jet member being sealed in the holes and having a lateral port in communication with the manifold chamber for feeding ink from the manifold chamber to the ink chamber in the tubular jet member.

2. A system as set forth in claim 1 wherein each tubular member extends into the respective hole in the front wall with the valve seat at the said one end of the tubular member generally at the front end of that hole.

3. Ink jet printing apparatus comprising:

a plurality of ink jets;

means mounting the jets in a matrix for non-contact printing of patterns of dots to form characters on a target surface moving past the jets, by selective squirting of drops of ink from the jets, each jet comprising an elongate tubular member having an outlet nozzle constituting a valve seat at one end thereof, said seat having an orifice for ejection of drops of ink, said tubular member having an ink chamber therein for holding ink under pressure for delivery through the orifice, said chamber being defined by the valve seat and by means sealing against escape of ink from the chamber, a valve stem extending longitudinally in said tubular member having a valve member at its end toward the seat engageable with the seat to block flow of ink through the orifice in the seat, the valve stem being movable longitudinally in said tubular jet member for closing the valve member against the seat and for opening it for ejection of a drop of ink through the orifice, means for supplying the ink chambers of said tubular jet members with ink under pressure, and a plurality of solenoids, one for each jet, each connected to a respective valve stem for actuating the latter, wherein the mounting means for the jets comprises an ink manifold for holding ink under pressure, said manifold having a front wall and a back wall spaced from each other and defining therebetween a manifold chamber for holding ink under pressure, said walls having a plurality of holes receiving the tubular jet members with the latter extending through the holes in the back wall across the manifold chamber into the holes in the front wall, each tubular jet member being sealed in the holes and having a lateral port in communication with the manifold chamber for feeding ink from the manifold chamber to the ink chamber in the tubular jet member.

4. Ink jet printing apparatus as set forth in claim 3 wherein each tubular member extends into the respective hole in the front wall with the valve seat at the said one end of the tubular member generally at the front end of that hole.

5. Ink jet printing apparatus as set forth in claim 3 wherein each tubular jet member has a tubular body member at its other end, constituting its rearward end, a resilient diaphragm in said body member having a central coupler extending forward and rearward, the valve stem being secured at its rearward end to the coupler, the solenoid for operating the valve stem being mounted on the rearward end of a solenoid support tube extending rearward from the body member, the solenoid having plunger and interconnected with the coupler at the rearward end of the latter via a drive wire extending through the support tube.

6. Ink jet printing apparatus as set forth in claim 5 wherein the drive wire is flexible and at least some of the tubes are bent to flare outwardly.

7. An ink jet printhead for an ink jet printing system for ink jet printing of messages on objects being fed forward one after another in a predetermined path, said printhead being adapted to be positioned adjacent said path to print the message on the objects as they travel forward in said path, said printhead comprising:

a plurality of ink jets arranged in a matrix with the jets in close array and in a pattern for ejection of drops of ink across a gap to a surface of an object travelling by the printhead to print dots on said surface in patterns forming selected characters for said messages;

each jet comprising:

an elongate tubular member having an outlet nozzle constituting a valve seat at one end thereof, said seat having an orifice for ejection of drops of ink, said tubular member having an ink chamber therein for holding ink under pressure for delivery through the orifice, said chamber being defined by the valve seat and by means sealing against escape of ink from the chamber;

a valve stem extending longitudinally in said tubular member having a valve member at its end toward the seat engageable with the seat on the inside to block flow of ink through the orifice in the seat;

the valve stem being movable longitudinally in said tubular jet member for closing the valve member against the seat and for opening it for ejection of a drop of ink through the orifice;

means for supplying ink under pressure to the ink chambers of said tubular jet members;

a plurality of solenoids, one for each jet, said solenoids being spaced away from valve seats and more widely spaced relative to one another than the jets in said matrix;

drive means interconnecting each solenoid and the valve stem of the respective jet for actuation by each solenoid of the respective valve stem and the respective valve member, wherein the drive means interconnecting each solenoid and the respective valve stem comprises a flexible drive wire allowing for the wider spacing of the solenoids than the jets, having a solenoid support tube extending from each tubular member, at least some of said tubes flaring outwardly for said wider spacing of the solenoids than the jets, each solenoid being mounted on the end of its respective support tube away from the respective tubular member, each solenoid having a plunger, the flexible drive wire for each valve stem being interconnected with the plunger of the respective solenoid and extending through the respective solenoid support tube, and wherein as to each jet the means sealing against the escape of ink from the respective chamber comprises a resilient diaphragm, the valve stem of and the drive wire for each jet being secured to the respective diaphragm at opposite sides thereof.

8. A system for ink jet printing of messages on objects being fed forward one after another in a predetermined path, said system comprising:

a plurality of ink jet printheads positioned adjacent said path to print the messages on the articles as they travel forward in said path;

each printhead comprising a plurality of ink jets arranged in a matrix and adapted for ejection of drops of ink across a gap to a surface of an object travelling by the printhead to print dots on said surface in patterns forming selected characters for said messages;

means for supplying ink to the jets;

a plurality of electrically actuated valve means, one for each jet, each adapted for electrical operation for ejection of a drop of ink from the respective nozzle;

a terminal including a keyboard for entering message data;

a message bank having a microcomputer interconnected with the terminal for processing data received from the terminal and storing the data for a plurality of messages;

a plurality of controllers, one for each printhead, each including a microcomputer interconnected with the bank for processing data for a selected message rceived from the bank and storing the data;

means for effectng transfer of data for a selected message from the bank to a selected controller for storage in that controller and for transferring predetermined information from each microcomputer of each controller to the microcomputer of the message bank;

each controller having an output circuit interconnected with the mirocomputer thereof and with the respective printhead for receiving output of data for the selected message from that microcomputer and converting the data to driving signals for the printhead valve means for actuating the latter to print the selected message;

wherein each jet of each printhead comprises:

an elongate tubular member having an outlet nozzle constituting a valve seat at one end thereof, said seat having an orifice for ejection of drops of ink;

said tubular member having an ink chamber therein for holding ink under pressure for delivery through the orifice, said chamber being defined by the valve seat and by means sealing against escape of ink from the chamber;

a valve stem extending longitudinally in said tubular member having a valve member at its end toward the seat engageable with the seat to block flow of ink through the orifice in the seat;

the valve stem being movable longitudinally in aid tubular jet member for closing the valve member against the seat and for opening it for ejection of a drop of ink through the orifice, said ink supply means supplying the ink chambers of said tubular jet members with ink under pressure;

each printhead having a plurality of solenoids, one for each jet, each connected to a respective alve stem for actuating the latter;

wherein said solenoids are spaced away from the valve seats and more widely spaced relative to one another than the jets in said matrix;

wherein each solenoid is connected to the respective valve stem by drive means comprising a flexible drive wire allowing for the wider spacing of the solenoids than the jets;

having a solenoid support tube extending from each tubular member, at least some of said tubes flaring outwardly for said wider spacing of the solenoids than the jets, each solenoid being mounted on the end of its respective support tube away from the rspective tubular member, each solenoid having a plunger, the flexible drive wire for each valve stem being interconnected with the plunger of the respective solenoid and extending through the respective solenoid support tube, and wherein as to each jet the means sealing against the escape of ink from the respective chamber comprises a resilient diaphragm, the valve stem of and the drive wire for each jet being secured to the respective diaphragm at opposite sides thereof.

9. A printing jet discharge head assembly for applying characters to an article, said head assembly comprising:

a chamber for receiving and holding printing liquid under pressure;

a plurality of outlet orifices in said chamber for discharging printing liquid therefrom, said outlet orifices being arranged sufficiently close together to form legible characters from the discharges of said orifices;

a plurality of closure elements within said chamber and operatively associated with respective outlet orifices, said closure elements being selectively displacable toward and away from said outlet orifices for closing and opening respective orifices;

resilient means to urge said closure elements toward said outlet orifices for closing said orifices;

a plurality of pulling means for selectively moving said closure elements away from said outlet orifices for opening said orifices to discharge printing liquid therefrom to form the characters, said pulling means comprising a plurality of selectively operable actuators located outside said chamber, said actuators being of a size too large to enable direct coupling to said closely spaced closure elements, and a corresponding plurality of flexible pulling elements, each of said flexible pulling elements connecting a respective one of said actuators with a respective one of said closure elements to enable said actuators to selectively withdraw said closure elements from said orifices, the flexible pulling elements obtaining the coupling of the actuators to the closure elements while permitting a substantially unrestricted location of said actuators relative to said chamber and closure elements.

10. The printing jet discharging head assembly according to claim 9 wherein said pulling means includes a hollow flexible tube connected to each of said actuators and sealingly connected to said chamber proximate one of said closure elements, and wherein said flexible pulling element comprises a flexible wire passing through each of said flexible tubes to couple each of said actuators to one of said closure elements.

11. The printing jet discharging head assembly according to claim 9 wherein said closure elements are so arranged as to be axially displaceable toward and away from said respective orifices.

12. The printing jet discharging head assembly according to claim 9 wherein said actuator is an electromagnetic linear motor.

13. The printing jet discharging head assembly according to claim 12 wherein asid actuator is a solenoid.

14. The printing jet discharging head assembly according to claim 9 wherein said chamber and actuators are mounted in a common housing.

15. The printing jet discharging head assembly according to claim 9 further defined as operatively associated with means for effecting relative movement between an article to be marked and said assembly.

16. A system for ink jet printing of messages on objects being fed forward one after another in a predetermined path, said system comprising:

a plurality of ink jet printheads positioned adjacent said path to print the messages on the articles as they travel forward in said path;

each printhead having an ink chamber;

means defining a plurality of outlet jet orifices arranged in a matrix and adapted for ejection of drops of ink across a gap to a surface of an object travelling by the printhead to print dots on said surface in patterns forming selected characters for said messages;

a plurality of valve members which are selectively displaceable to open and close respective orifices;

resilient means arranged to urge said valve members to close the orifices;

a plurality of electrical pulling means actuable to effect pulling and associated with respective valve members and spaced therefrom;

a plurality of elongate pulling elements connecting the valve members to respective electrical pulling means so that the electrical pulling means are actuable to pull respective valve members against the urging of the resilient means to open respective orifices;

means for supplying ink to the chamber;

a terminal including a keyboard for entering message data, a message bank having a microcomputer interconnected with the terminal for processing data received from the terminal and storing the data for a plurality of messages, a plurality of controllers, one for each printhead, each including a microcomputer interconnected with the bank for processing data for a selected message received from the bank and storing the data, means for effecting transfer of data for a selected message from the bank to a selected controller for storage in that controller, each controller having an output circuit interconnected with the microcomputer thereof and with the respective printhead for receiving output of data for the selected message from that microcomputer and converting the data to driving signals for the electrical pulling means for actuating the valve members to print the selected message.

* * * * *